United States Patent [19]

Csadenyi

[11] Patent Number: 4,846,143

[45] Date of Patent: Jul. 11, 1989

[54] SMALL GAS POWER BURNER

[75] Inventor: George L. Csadenyi, Fort Wayne, Ind.

[73] Assignee: Lincoln Foodservice Products, Inc., Fort Wayne, Ind.

[21] Appl. No.: 183,621

[22] Filed: Apr. 19, 1988

[51] Int. Cl.[4] ..... F24C 3/08

[52] U.S. Cl. ..... 126/39 E; 126/21 A; 431/354

[58] Field of Search ..... 126/39 E, 21 A, 21 B; 431/354

[56] References Cited

U.S. PATENT DOCUMENTS

| | | | |
|---|---|---|---|
| 2,039,890 | 5/1936 | Coster | 431/354 |
| 3,695,820 | 10/1972 | Hawkes et al. | 431/354 |
| 4,224,019 | 9/1980 | Dilmore | 431/354 X |
| 4,457,291 | 7/1984 | Henke . | |

*Primary Examiner*—Larry Jones

*Attorney, Agent, or Firm*—Albert L. Jeffers; John F. Hoffman

[57] ABSTRACT

A gas power burner having a burner tube closed at one end and a venturi tube disposed within the burner tube with the mouth portion of the venturi tube disposed toward the closed end of the burner tube. The burner tube is provided with an air aperture in a side thereof at a position along the burner tube intermediate the mouth portion and the burner head portion of the venturi tube. A blower blows air into the air aperture of the burner tube where the air divides into a first pathway traveling toward the closed end of the burner tube and into the mouth of the venturi tube and also traveling in a second pathway toward the open end of the burner tube. The air traveling in the primary and secondary pathways provides combustion air for a flame burning at a burner head portion of the venturi located within the outer burner tube. A gas orifice communicates combustible gas with the mouth portion of the venturi tube and meters and directs gas to the mouth portion for mixing with combustion air from the primary pathway.

13 Claims, 4 Drawing Sheets

SMALL GAS POWER BURNER

BACKGROUND OF THE INVENTION

The present invention relates generally to small burners for combustible gas designed for a maximum gas consumption rate of less than 60,000 BTU/hr., and more particularly to such a gas burner having a forced air draft, also known as a power burner.

In the gas burner art it has been the practice to use atmospheric burners in applications where a maximum gas consumption rate less than 60,000 BTU/hr. is desired. An atmospheric burner draws combustion air at atmospheric pressure into a mixing tube by the action of a stream of pressurized combustible gas flowing through an orifice at relatively high velocity into the mixing tube. The proper air-gas mixture is obtained by regulating the pressure of the gas and providing an air inlet aperture in the mixing tube which is sized to admit the proper amount of air in relation to the gas flow rate determined by the gas pressure and orifice size.

Atmospheric burners may be used either in an open area or in an enclosed space having a suitable exhaust flue, so long as the air surrounding the flame is relatively quiescent. Atmospheric burners do not perform well in the presence of turbulent ambient air, and are susceptible to being blown out under such condition. An example of an atmospheric burner used in an open area is the surface burner of a kitchen range. An example of an atmospheric burner used in an enclosed space is the burner of a conventional home heating furnace. In the first example the flame burns in the quiescent atmosphere of the typical kitchen and in the second example the flame is maintained in a relatively quiescent atmosphere by the use of a heat exchanger which separates the enclosed combustion compartment from the moving air passing through the heating plenum under the influence of the furnace blower.

Where it is desired to use a gas burner having a relatively large gas combustion rate on the order of several hundred thousand BTU/hr., it has been the practice in the gas burner art to use a power burner having a forced air draft. Rather than relying exclusively upon the flow of pressurized gas through an orifice to draw combustion air into the burner, a power burner is provided with an air blower to force combustion air into the burner at a rate in excess of that which could be drawn by a conventional atmospheric burner. Power burners, because of their relatively large gas and combustion air flow rates, typically generate a long torch-like flame which, if it is to burn in an enclosed space, is usually provided with a combustion chamber of sufficient size to permit the full length of the flame to be developed for efficient combustion. Large power burners are typically used in connection with large heating plants such as a steam boiler where there is no difficulty in providing a large combustion chamber.

In certain applications it is desirable to employ a small gas burner having a maximum gas consumption rate on the order of 60,000 BTU/hr. or less where the flame must burn in a relatively small combustion area in the presence of non-quiescent, circulating air, where the circulating air is used as a heat transfer medium. For reasons of efficiency and space limitation, the products of combustion of the burner are introduced directly into the circulating air without the use of a heat exchanger. An example of such a use is a food preparation oven having a chamber for receiving and heating food and duct means and impeller means for recirculating air in the chamber, where the gas burner is disposed in the path of the circulating air. Heretofore, small food preparation ovens having a maximum heat requirement of less than 60,000 BTU/hr. have employed electric resistance heating elements which suffer no deleterious effect from turbulent, high velocity air passing over them. For reasons of energy efficiency and economy, however, it would be desirable to replace the electric resistance heating elements with a gas burner. However, the only gas burners heretofore commercially available having a maximum gas consumption rate of 60,000 BTU/hr. or less have been atmospheric burners.

Atmospheric burners are unsuitable for use in an environment where the atmosphere surrounding the flame is non-quiescent and where the products of combustion are directly mixed with heated air for cooking food. Under such conditions, atmospheric burners either have their flames disrupted by the turbulence of the surrounding atmosphere such that clean combustion is not obtained or the turbulence of the atmosphere surrounding the burner periodically blows the flame out. Furthermore, accidental or intentional obstruction of the air circulating ducts of such a food preparation oven while in use can result in a transient change in the pressure condition of the atmosphere surrounding the burner such that an undesired pressure relative the burner is produced. This can cause a reversal of the direction of flow of the air-gas mixture in the burner, resulting in a back fire where flame exits through the combustion air inlet of the burner, causing a safety hazard condition.

In order to overcome problems associated with the use of an atmospheric gas burner in a turbulent atmosphere it would be desirable to employ a power burner where by virtue of the use of a combustion air blower a positive pressure condition could be maintained in the burner relative the combustion chamber of the oven at all times. It would further be desirable to provide such a power burner having an appropriate small heat output with a maximum of less than 60,000 BTU/hr. and preferably on the order of 40,000 BTU/hr. and which is of disproportionately smaller physical dimensions than conventional large power burners and having a disproportionately shorter flame. This would permit the burner to be located in a relatively small space and also permit the flame to achieve complete combustion within the relatively small combustion space available without being disrupted by intervening structure. A suitable small gas power burner is provided by the present invention.

SUMMARY OF THE INVENTION

The present invention involves a small gas power burner having forced combustion air draft and a maximum gas flow rate of less than 60,000 BTU/hr. A venturi tube is located within a surrounding burner tube with combustion air being introduced into the burner tube through an aperture in the side thereof by a blower. The aperture is located intermediate the length of the venturi tube such that a portion of the air entering the burner tube through the side aperture travels backwards down the burner tube and into the mouth of the venturi tube where it mixes with combustible gas. A second portion of the combustion air entering the aperture in the side of the burner tube travels in the opposite direction toward the forward end of the tube where it interacts with a flame burning at the burner head end of the venturi tube supplementing the combustion air provided within the venturi tube.

The invention provides a gas power burner having a heat output in the range of 60,000 BTU/hr. and below. Power burners in this heat range have not heretofore been available. Such a power burner alleviates the problems discussed above with respect to the use of atmospheric burners especially in the presence of a turbulent atmosphere and where physical space is restricted and/or it is undesirable or impossible to provide a heat exchanger to separate the products of combustion from the burner from the air which is to be heated. The invention provides a gas burner in the desired heat range utilizing the advantages of power burner technology with a small burner size and short flame length not heretofore available.

The invention, in one form thereof, provides a gas power burner having a burner tube with an open end and a closed end and a venturi tube disposed longitudinally within the burner tube. The venturi tube has a mouth portion and a burner head portion and a throat portion therebetween. The mouth portion extends toward the closed end of the burner tube and has an air inlet aperture communicating the mouth portion with the burner tube. The burner head portion extends toward the open end of the burner tube. Gas orifice means are provided for communicating a source of combustible gas with the mouth portion of the venturi tube for metering and directing gas into the mouth portion. The burner tube has an air aperture in a side thereof at a position along the burner tube intermediate the air inlet aperture of the mouth portion and the burner head portion of the venturi tube. Air blower means are provided in communication with the air aperture of the burner tube for blowing air into the burner tube through the air aperture.

It is an object of the present invention to provide a gas power burner with forced air draft which operates at relatively low heat output levels heretofore available only from atmospheric gas burner.

Other objects and advantages of the present invention will become apparent from the following description.

DESCRIPTION OF A PREFERRED EMBODIMENT

Figure 1:
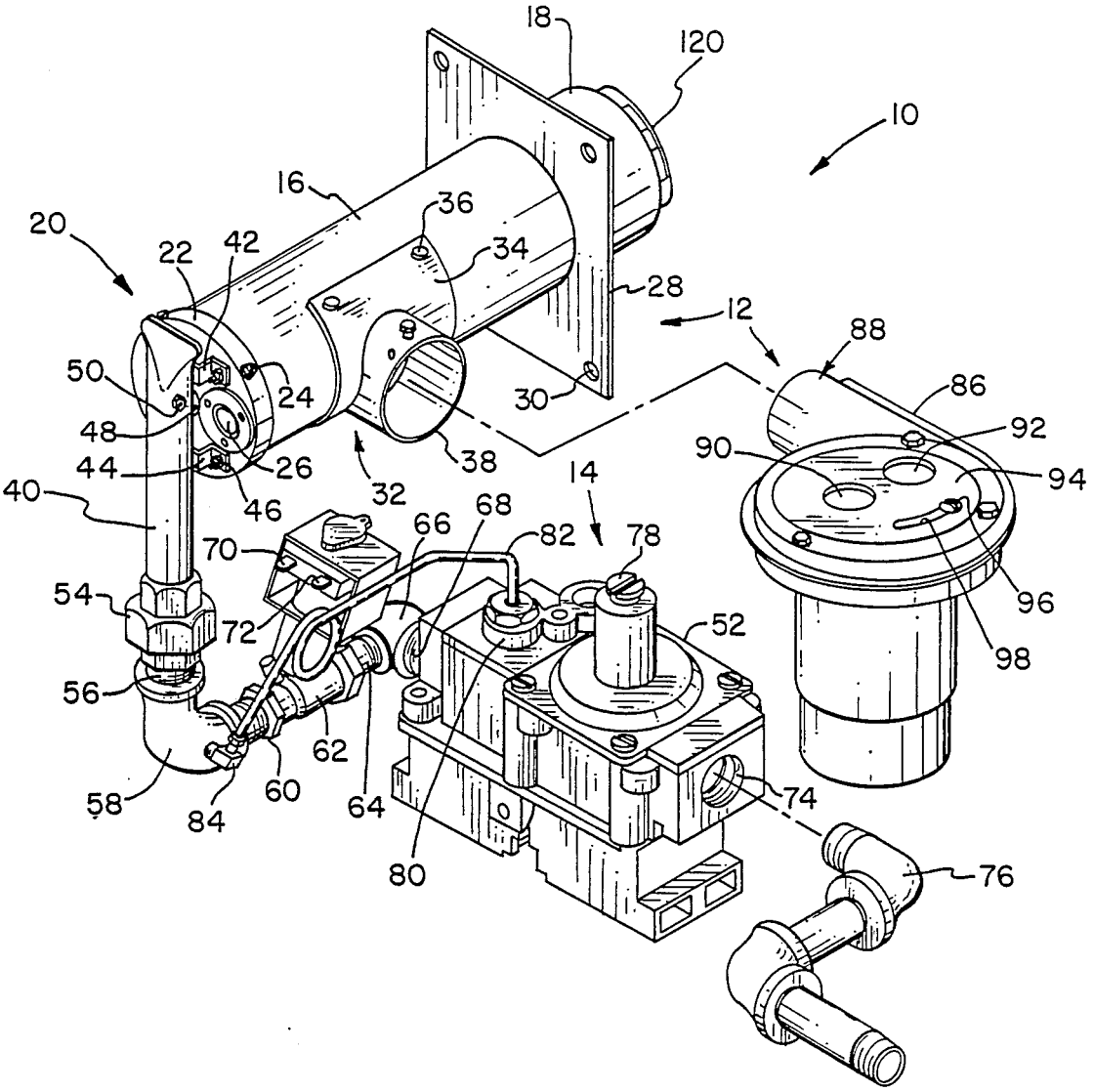
FIG. 1 is a partially exploded perspective view of a gas power burner in accordance with the present invention, particularly showing the combustible gas delivery and regulation system.

Referring in particular to FIG. 1, there is illustrated a gas power burner assembly 10 including a gas power burner 12 and a gas delivery and regulation system 14. Gas power burner 12 includes a hollow cylindrical metal burner tube 16 having an open end 18 and an opposite end 20 closed by a sheet metal burner cap 22 secured to burner tube 16 by screws 24. Burner cap 22 includes a transparent sight glass 26 disposed at the rear end of burner tube 16 to provide a viewing port whereby the flame in burner tube 16 can be observed. Welded to burner tube 16 proximate the front end thereof is mounting flange 28 having holes 30 by means of which burner tube 16 can be, for example, secured to a wall in a food preparation oven separating a combustion chamber (into which open end 18 protrudes) from a control chamber in which the remainder of gas power burner assembly 10 is disposed. Disposed on the side of burner tube 16 is air blower adaptor 32 including a semi-cylindrical portion 34 engaging and secured to burner tube 16 by screws 36 and a cylindrical tube portion 38 extending transversely from burner tube 16. Semi-cylindrical portion 34 and cylindrical tube portion 38 preferably comprise an integral assembly constructed of cast aluminum.

Rigidly affixed to burner cap 22 at the rear end of burner tube 16 is a gas manifold 40 having a pair of transversely oriented mounting brackets 42 and 44 welded to manifold 40 and attached to burner cap 22 by screws 46. A gas orifice (not shown in FIG. 1) affixed to manifold 40 in flow communication therewith extends through an opening 48 in burner cap 22 in concentric alignment with burner tube 16. Opening 48 is sized to receive the gas orifice such that the gas orifice substantially closes opening 48 with respect to atmosphere. A pipe plug 50 is disposed in a threaded pressure tap in manifold 40 to which a manometer can be connected for measuring the gas pressure in manifold 40.

Gas manifold 40 is connected in flow communication to the outlet of a gas pressure regulator and control valve 52 via union joint 54, nipple 56, elbow 58, nipple 60, electric solenoid valve 62, nipple 64, elbow 66 and nipple 68. Pressure regulator and control valve 52 is preferably a commercially available device such as Model No. G54CBG-2, manufactured by Johnson Controls, Inc. Electric solenoid valve 62 is actuated by control means not shown which applies electric current to terminals 70 and 72. Valve 62 is of the non-modulating type in which the valve is either fully open or fully closed.

Gas is supplied to inlet 74 of pressure regulator and control valve 52 from a source of combustible gas, preferably natural gas or L.P. gas, via conventional gas piping as shown at reference numeral 76. Pressure regulator and control valve 52 has an internal pressure regulator which is adjustable by screw 78 and also has an internal non-modulating on/off valve remotely actuable by a control means not shown for turning on and shutting off the flow of gas from inlet 74 to outlet nipple 68. Located downstream of the on/off valve and pressure regulator of unit 52 is a pressure tap 80 in communication with outlet nipple 68 via an internal passage in unit 52. In the preferred embodiment a $\frac{1}{4}$ inch diameter bypass tube 82 bypasses electric solenoid valve 62 and communicates with manifold 40 via a pipe elbow 84 threadedly received in elbow 58.

During operation of gas delivery and regulation system 14, high and low gas flows are provided. High gas flow is at a rate of about 40,000 BTU/hr. and low gas flow is at a rate of about 10,000 BTU/hr. When high gas flow is desired, the internal valve of pressure regulator and control valve 52 is opened and electric solenoid valve 62 is also opened, providing parallel gas flow paths firstly through nipple 68, elbow 66, nipple 64, solenoid valve 62, nipple 60, and elbow 58 and secondly through pressure tap 80, bypass tube 82, pipe elbow 84, and elbow 58. Final metering of the gas flow into burner tube 16 is provided by the gas orifice extending from manifold 40 into burner tube 16 through burner cap 22. When low gas flow is desired, the internal valve of pressure regulator and control valve 52 remains open but electric solenoid valve 62 is closed. In this configuration bypass tube 82 continues to provide gas to manifold 40 but at a significantly reduced flow rate due to the presence of a second metering orifice located in pressure tap 80, which second orifice is sufficiently smaller than the gas orifice connected to manifold 40 to provide the principle gas metering action at low gas flow.

Attached to air blower adaptor 32 is centrifugal squirrel cage blower and motor 86 having an outlet duct 88 which is received in cylindrical tube portion 38 of air blower adaptor 32. Blower 86 is provided with air inlet apertures 90 and 92 which may be selectively covered by rotatable shutter plate 94 which can be secured in a selected position by screw 96 disposed in arcuate slot 98.

Figure 2:
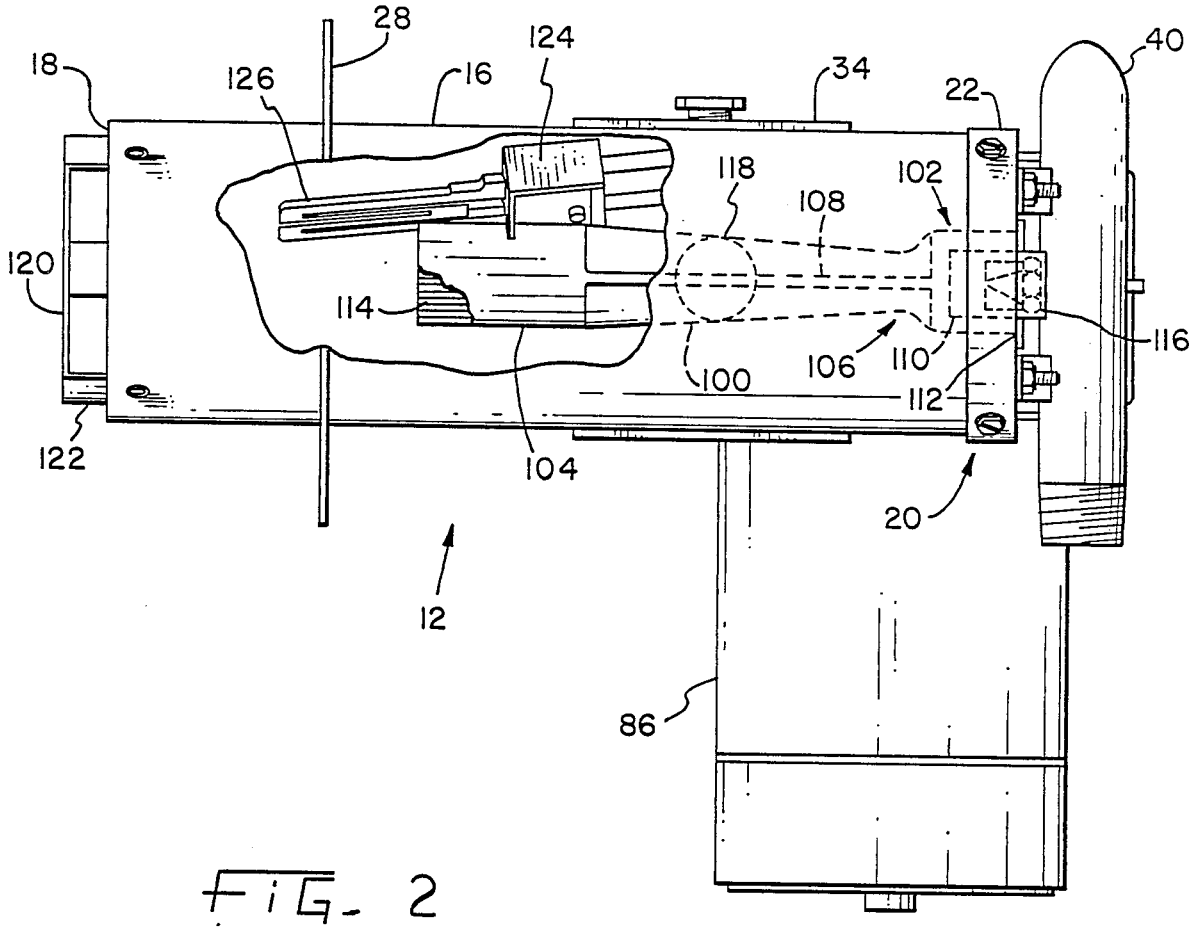
FIG. 2 is a partially cut away side elevational view of the gas power burner of FIG. 1.
Figure 3:
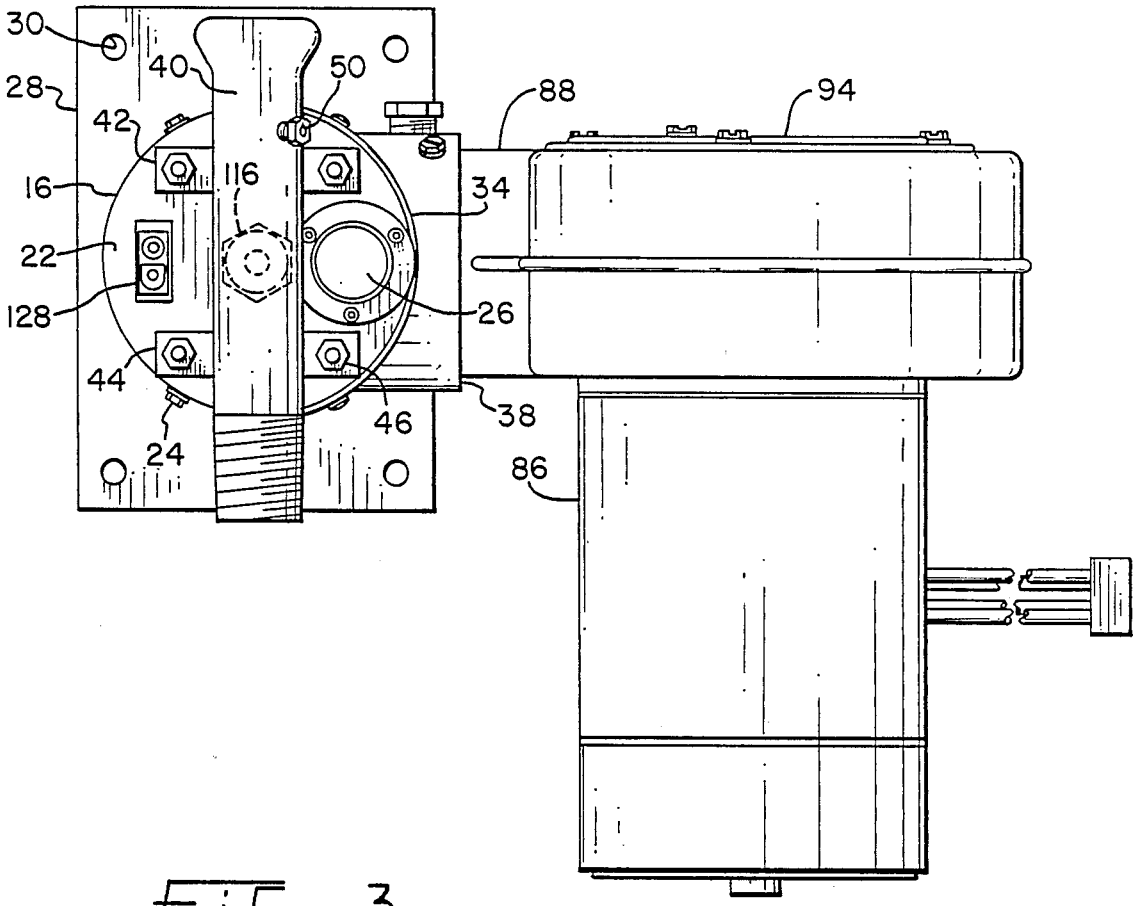
FIG. 3 is a rear end elevational view of the gas power burner of FIG. 1.

Referring in particular to FIGS. 2 and 3, gas power burner 12 is shown in greater detail. Disposed longitudinally and concentrically within burner tube 16 is a venturi tube 100 having a mouth portion 102 and a burner head portion 104. Between mouth portion 102 and burner head portion 104 venturi tube 100 has a constricted throat portion 106. Throat portion 106 is located closer to mouth portion 102 than to head portion 104. Venturi tube 100 expands linearly in diameter from neck portion 106 toward burner head portion 104. Venturi tube 100 is stamped from sheet metal and includes longitudinal ribs 108 on either side of the tapered portion between mouth portion 102 and burner head portion 104. Mouth portion 102 is provided with two air inlet apertures 110 in the sides thereof opposite one another. The end of mouth portion 102 is welded to burner cap 22 at their juncture 112. Disposed within burner head portion 104 is an annular corrugated flame retention ring 114 providing a multitude of longitudinal slots between ring 114 and venturi tube 100 which cause a flame to burn on the end of burner head portion 104 and to be evenly distributed about the circumference thereof. Furthermore, retention of the flame adjacent the circumference of head portion 104 is facilitated by ring 114. Disposed within mouth portion 102 and extending from manifold 40 through burner cap 22 is gas orifice 116 which meters pressurized gas in manifold 40 and directs it into mouth portion 102 and through throat portion 106 where the stream of gas is mixed with combustion air entering mouth portion 102 via air inlet apertures 110 from burner tube 16.

Burner tube 16 has an air aperture 118 in the side thereof located concentrically with respect to cylindrical tube 38 of air blower adaptor 32, of which the semicylindrical portion 34 is visible in FIG. 3. Air aperture 118 is circular in shape and approximately $\frac{7}{8}$ inch diameter which is of lesser diameter than duct 88 of blower 86. Air aperture 118 is located along burner tube 16 at a position which is intermediate the air inlet apertures 110 of mouth portion 102 and burner head portion 104.

Blower 86 blows air into burner tube 116 through air aperture 118 in a direction transverse to the longitudinal axis of burner tube 16 and venturi tube 100. Since air aperture 118 is of lesser diameter than duct 88 of blower 86, the cubic feet per minute of air entering air aperture 118 is reduced from the rated capacity of 300 CFM of blower 86, but the velocity of the air entering through aperture 118 is thereby increased over the normal exit velocity of air from blower 86. Aperture 118 is aligned with the center line of blower tube 16 and venturi tube 100, thereby causing the air entering through aperture 118 to strike venturi tube 100 broadside. The air thereupon divides and a portion flows toward the closed end of burner tube 16 and through air inlet apertures 110 of mouth portion 102 and thence through throat portion 106 and burner head portion 104 of venturi tube 100. The portion of the air from blower 86 which enters mouth portion 102 of venturi tube 100 and mixes therein with combustible gas from orifice 116 is deemed primary combustion air. A second portion of the air entering burner tube 16 from blower 86 travels toward the open end 18 of burner tube 16 in the annular space formed between venturi tube 100 and burner tube 16. The air traversing this latter pathway is deemed secondary combustion air which together with the primary combustion air already mixed with the gas in venturi tube 100 provides complete combustion of the gas in a flame at the end of burner head portion 104.

A disk shape stainless steel flame target 120 is secured to the open end 18 of burner tube 16 by support legs 122 in the path of the flame issuing from the end of burner tube 104. Target 120 serves to shape the flame such that the flame exits around the edges of target 120 between support legs 122 and thereafter converges inwardly toward the extended center axis of burner tube 16, whereby the flame is rendered in the shape of a mushroom and the length of the flame is shortened from what it would be in the absence of target 120.

Affixed to burner head portion 104 is bracket 124 which supports a conventional electrical hot surface ignitor 126 which extends beyond the end of burner head portion 104 and is inclined at a slight angle with respect to the center line of burner tube 16 such that hot surface ignitor 126 is situated in the path of the air-gas mixture issuing from venturi tube 100 and, upon ignition of the air-gas mixture, is situated within the flame. The air-gas mixture is ignited by applying electric current to hot surface ignitor 126 via electrical connector 128 mounted in burner cap 22 which causes hot surface ignitor 126 to heat to a temperature sufficient to ignite the gas-air mixture issuing from venturi tube 100. Subsequent to ignition, current to hot surface ignitor 126 is turned off by control means not shown and ignitor 126 thereafter performs the function of flame detection by the principle of flame rectification. It is a phenomenon of burning flames that the flame is conductive of electrical current to a much greater extent than air. Sensor means not shown are electrically connected to hot surface ignitor 126 and electrically grounded venturi tube 100, to detect the passage of current from venturi 100 to hot surface ignitor 126. Such a current, if present, is on the order of a few microamperes and is thus indicative of the presence of a flame. If a flame is not continuously detected by the sensor means, other control means not shown shut off gas supply to gas power burner 12.

Prior large gas power burners which employ a venturi tube within an outer burner tube have an air blower situated in alignment with the air inlet aperture of the mouth portion of the venturi tube such that the greatest portion of the air blown into the burner tube passes directly into the venturi tube causing a high velocity flow of gas-air mixture through the venturi tube. Such prior power burners, which are designed for a gas consumption rate typically on the order of 100,000 BTU/hr. or greater are physically larger and have larger diameter venturi tubes than that of the present invention. Mere proportional scaling down of a large power burner of the type discussed immediately above does not result in a satisfactory small power burner which works effectively with clean combustion and a stable flame. A proportionately scaled down version of a large power burner is believed to result in a burner wherein the flame tends to lift off of the end of the burner head portion of the venturi tube and often the flame blows out completely or cannot be ignited. This phenomenon is believed to be due to the fact that the cross-sectional area of the venturi tube varies in proportion to the square of its radius whereas the circumference of the end of the burner head portion of the venturi tube varies linearly with respect to the radius of the venturi tube. Consequently with a smaller venturi tube the smaller circumference at the burner head end is not sufficient to support a flame strong enough to resist being blown out by the high velocity air-gas mixture traveling through the center of the venturi tube. Performance in a small power burner is believed to be enhanced by disproportionately reducing the velocity of the air-gas mixture through the center of the venturi tube and correspondingly increasing the proportion of the combustion air interacting with the flame on the exterior of the venturi tube. The present invention introduces combustion air into the venturi tube through a constricted aperture in the side of the burner tube at high velocity transversely to the longitudinal axis of the burner tube at a point forwardly of the air inlet aperture of the venturi tube. The result is an effective reproportioning of the respective air flows through the venturi tube and along side the venturi tube such that a relatively greater portion of the combustion air is provided via the secondary pathway outside the venturi tube as compared to larger power burners. The sum of the combustion air traveling through the primary pathway inside the venturi tube and the combustion air traveling via the secondary pathway between the venturi tube and the burner tube must be sufficient to provide complete combustion of the gas introduced into the venturi tube.

The present invention provides a small gas power burner which provides a stable reliably ignitable flame for generating heat at a maximum rate less than 60,000 BTU/hr. In addition, the burner is of a desirably small physical dimension and is capable of operating in the presence of a turbulent atmosphere. As an example, burner tube 16 can be approximately three (3) inches in diameter and nine (9) inches in length with venturi tube 100 having an overall length of approximately six (6) inches and extending about ⅔ of the length of burner tube 16 from burner cap 22. Venturi tube 100 can have a diameter of approximately one (1) inch at burner head portion 104, or about ⅓ the diameter of burner tube 16. Gas orifice 116 extends approximately ⅜ inch into mouth portion 102 from burner cap 22, with an orifice bore diameter of approximately 0.120 inch for natural gas or 0.074 inch for L.P. gas. Gas is supplied to manifold 40 at a regulated pressure of approximately 3.5 inches water column for natural gas or 10 inches water column for L.P. gas. The center of air aperture 118 is located approximately three (3) inches from the closed end of burner tube 16 or about ½ the distance between the closed end 20 of burner tube 16 and the end of burner head portion 104 of venturi tube 100. Air aperture 118 has a diameter of approximately ⅞ inch which comprises a restriction of the outlet duct 88 of blower 86, which outlet duct has a diameter of approximately 2 3/16 inches. Blower 86 is rated at 300 CFM at approximately 3,000 RPM with air apertures 90 and 92 fully open and air duct 88 unobstructed. Flame target 120 is approximately 2 inches in diameter and is spaced approximately ½ inch from the open end of burner tube 16. When dimensioned as recited above, gas power burner 12 generates about 40,000 BTU/hr. at high gas flow and about 10,000 BTU/hr. at low gas flow with an orifice bore diameter of approximately 0.059 inch for natural gas or 0.037 inch for L.P. gas in pressure tap 80.

Figure 4:
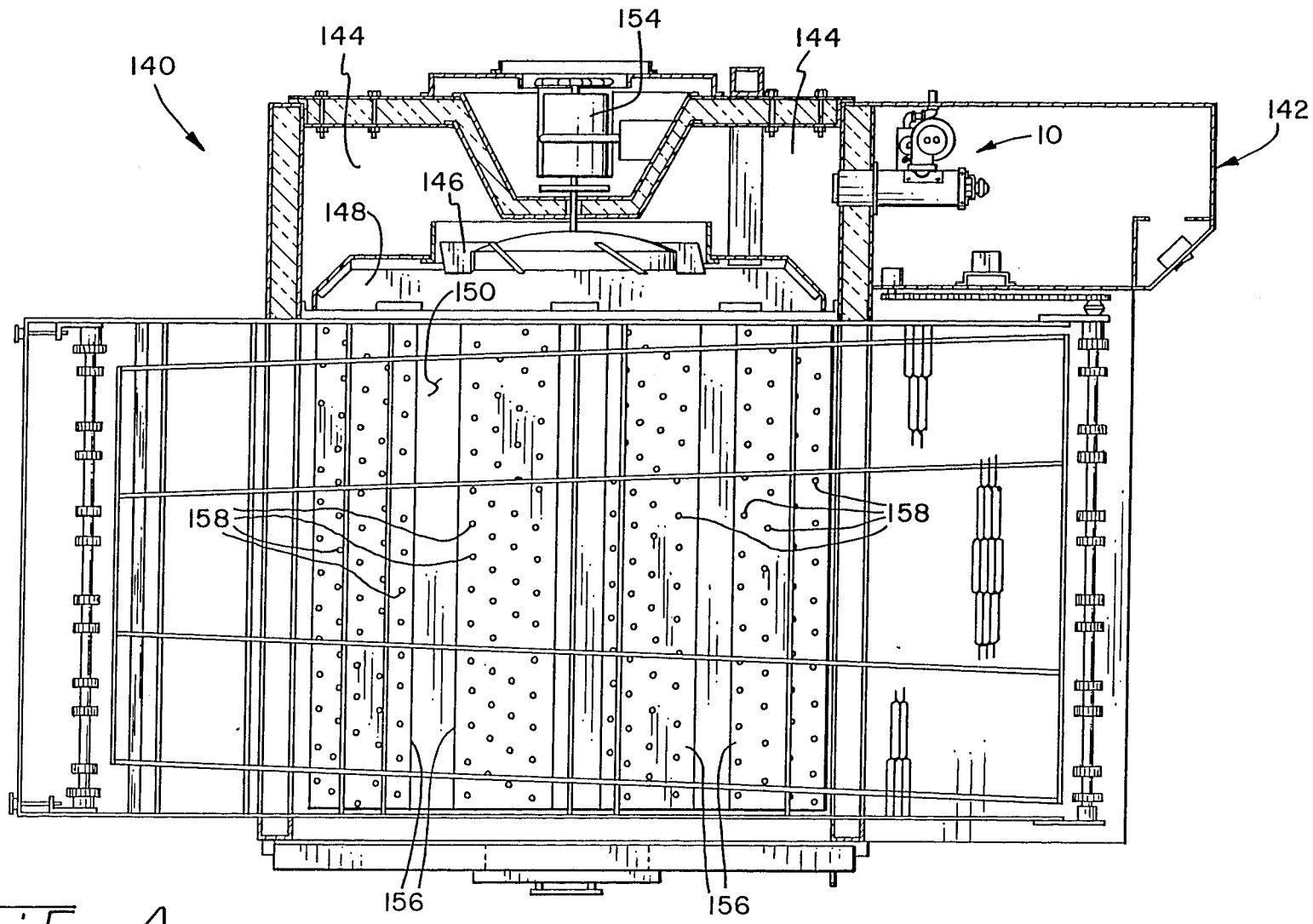
FIG. 4 is a broken away top plan view of a food preparation oven incorporating a gas power burner in accordance with the present invention.

Referring to FIG. 4, a food preparation oven 140 is illustrated and comprises oven control section 142, heating chamber 144, impeller 146, plenum 148, cooking chamber 150, and an incorporated embodiment of the present invention gas power burner assembly 10. Impeller 146 is operated by a motor 154 and cooking chamber 150 has a plurality of horizontally disposed heat ducts 156 each of which has a plurality of orifices or jets 158 disposed therein. The air within food preparation 140 is circulated by impeller 146 through heating chamber 144 where the air is heated to a desired temperature and then delivered to plenum 148 for subsequent passage to heat ducts 156. The heated air is then forced through jets 158 against a food product passed therealong. After the heated air has contacted the food product in cooking chamber 150 it is withdrawn by impeller 146 back into heating chamber 144 to be reheated and subsequently recirculated to cook other food products.

A more detailed description of the structure and operation of a typical food preparation oven in which gas power burner assembly 10 may be used can be found in U.S. Pat. Nos. 3,884,213 and 4,154,861, both of which are hereby incorporated by reference.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in he art to which this invention pertains and falls within the limits of the appended claims.

What is claimed is:

1. A gas power burner comprising:

a burner tube having an open end and a closed end;

a venturi tube disposed longitudinally within said burner tube, said venturi tube having a mouth portion and a burner head portion: and a throat portion therebetween, the mouth portion extending toward the closed end of said burner tube and having an air inlet aperture communicating the mouth portion with said burner tube, the burner head portion extending toward the open end of said burner tube;

gas orifice means communicating a source of combustible gas with the mouth portion of said venturi tube for metering and directing gas into the mouth portion;

said burner tube having an air aperture in a side thereof at a position along said burner tube intermediate the air inlet aperture of the mouth portion and the burner head portion of said venturi tube; and air blower means having a duct connected to said side of said burner tube in alignment with said air aperture for blowing air into said burner tube through said air aperture, said air aperture having a cross-sectional flow area that is much smaller than the cross-sectional flow area of said blower means duct, whereby air is blown through said air aperture at high velocity.

2. The gas power burner of claim 1, in which said gas orifice means meters combustible gas at a maximum rate of less than 60,000 BTU/hr.

3. The gas power burner of claim 1, in which said burner tube has a length less than ten inches.

4. The gas power burner of claim 1, in which the air aperture of said burner tube has a cross-sectional area corresponding to a circle having a diameter of about $\frac{7}{8}$ inch.

5. The gas power burner of claim 1, and further including means for regulating the source of combustible gas such that gas is selectively supplied at one of two flow rates.

6. The gas power burner of claim 5, in which one of the gas flow rates is about 40,000 BTU/hr. and the other of said gas flow rates is about 10,000 BTU/hr.

7. The gas power burner of claim 5, in which said means for regulating includes a gas pressure regulator between the source of combustible gas and said gas orifice means, and further including an on/off valve between the pressure regulating means and the gas orifice means and means for bypassing the on/off valve.

8. In a food preparation oven having a chamber for receiving and heating food and duct means and impeller means for recirculating air in the chamber, a gas power burner comprising:

a burner tube having an open end and a closed end;

a venturi tube disposed longitudinally within said burner tube, said venturi tube having a mouth portion and a burner head portion and a throat portion therebetween, the mouth portion extending toward the closed end of said burner tube and having an air inlet aperture communicating the mouth portion with said burner tube, the burner head portion extending toward the open end of said burner tube;

gas orifice means communicating a source of combustible gas at a maximum flow rate of less than 60,000 BTU/hr. with the mouth portion of said venturi tube for metering and directing gas into the mouth portion;

said burner tube having an air aperture in a side thereof at a position along said burner tube intermediate the air inlet aperture of the mouth portion and the burner head portion of said venturi tube; and air blower means having a duct connected to said side of said burner tube in alignment with said air aperture for blowing air into said burner tube through said air aperture, said air aperture having a cross-sectional flow area that is much smaller than the cross-sectional flow area of said blower means duct, whereby air is blown through said air aperture at high velocity.

9. The gas power burner of claim 8, in which said burner tube has a length less than ten inches.

10. The gas power burner of claim 8, in which the air aperture of said burner tube has a cross-sectional area corresponding to a circle having a diameter of about 7/8 inch.

11. The gas power burner of claim 8, and further including means for regulating the source of combustible gas such that gas is selectively supplied at one of two flow rates.

12. The gas power burner of claim 11, in which one of the gas flow rates is about 40,000 BTU/hr. and the other of said gas flow rates is about 10,000 BTU/hr.

13. The gas power burner of claim 11, in which said means for regulating includes a gas pressure regulator between the source of combustible gas and said gas orifice means, and further including an on/off valve between the pressure regulating means and the gas orifice means and means for bypassing the on/off valve.

* * * * *